US007731175B2

(12) United States Patent
Kang

(10) Patent No.: US 7,731,175 B2
(45) Date of Patent: Jun. 8, 2010

(54) IMAGE FORMING APPARATUS AND PAPER FEEDING METHOD USED WITH THE SAME

(75) Inventor: Sung-wook Kang, Seoul (KR)

(73) Assignee: Samsung Electronics Co., Ltd, Suwon-si (KR)

( * ) Notice: Subject to any disclaimer, the term of this patent is extended or adjusted under 35 U.S.C. 154(b) by 480 days.

(21) Appl. No.: 11/470,002

(22) Filed: Sep. 5, 2006

(65) Prior Publication Data

US 2007/0063429 A1 Mar. 22, 2007

(30) Foreign Application Priority Data

Sep. 22, 2005 (KR) ..... 10-2005-0088217

(51) Int. Cl.
*B65H 7/08* (2006.01)

(52) U.S. Cl. ..... 271/110; 271/245

(58) Field of Classification Search ..... 271/110, 271/114, 245

See application file for complete search history.

(56) References Cited

U.S. PATENT DOCUMENTS

| | | | | |
|---|---|---|---|---|
| 5,594,542 | A * | 1/1997 | Sugimoto et al. | 399/402 |
| 5,897,112 | A * | 4/1999 | Kwag | 271/38 |
| 5,971,392 | A * | 10/1999 | Lee | 271/265.02 |
| 6,011,948 | A * | 1/2000 | Amano et al. | 399/395 |
| 2005/0184447 | A1 * | 8/2005 | Tsukamoto et al. | 271/109 |
| 2005/0258592 | A1 * | 11/2005 | Mitsuya et al. | 271/258.01 |

FOREIGN PATENT DOCUMENTS

| | | |
|---|---|---|
| CN | 1572522 | 2/2005 |
| CN | 1618618 | 5/2005 |
| JP | 06-219573 | 8/1994 |
| JP | 2001-356613 | 12/2001 |
| JP | 2002-156802 | 5/2002 |
| JP | 2002-284399 | 10/2002 |

OTHER PUBLICATIONS

Chinese Office Action mailed Jul. 18, 2008 in CN200610125684.3.

* cited by examiner

*Primary Examiner*—Patrick Mackey
*Assistant Examiner*—Michael C McCullough
(74) *Attorney, Agent, or Firm*—Stanzione & Kim LLP

(57) ABSTRACT

An image forming apparatus and a paper feeding method used with the image forming apparatus. An image forming apparatus includes: a paper feeding unit to accommodate a plurality of papers loaded thereon; a pick-up roller which picks up the papers loaded in the paper feeding unit and is set to rotate at multi-step speeds; a paper arrangement unit which aligns the papers to be transferred without skewing by applying a constant pressure to the front end of a paper transferred by a the pick-up roller; a printing unit which is disposed below the paper arrangement unit and forms a predetermined image on the transferred paper; a paper type sensing element which is disposed on a paper transfer path along which the paper feeding unit, the pick-up roller, the paper arrangement unit, and the printing unit are arranged; and a control unit which operates the pick-up roller at a rotation speed according to an identified paper type. Accordingly, the image forming apparatus can prevent paper wrinkling or poor paper arrangement occurring in a paper arrangement process.

19 Claims, 6 Drawing Sheets

IMAGE FORMING APPARATUS AND PAPER FEEDING METHOD USED WITH THE SAME

CROSS-REFERENCE TO RELATED APPLICATIONS

This application claims the benefit of Korean Patent Application No. 10-2005-0088217, filed on Sep. 22, 2005, in the Korean Intellectual Property Office, the disclosure of which is incorporated herein in its entirety by reference.

BACKGROUND OF THE INVENTION

1. Field of the Invention

The present general inventive concept relates to an image forming apparatus and a paper feeding method used with the same, and more particularly, to an image forming apparatus that controls an arrangement speed according to paper thickness in order to prevent overall problems occurring during a paper arrangement process, and a paper feeding method used with the image forming apparatus.

2. Description of the Related Art

FIG. 1 is a view of an ink-jet printer as an example of a conventional image forming apparatus. Referring to FIG. 1, the image forming apparatus includes a paper feeding unit 10 that stores a plurality of papers P (or other recording media) and a pick-up roller 11 to pick up the papers P sheet by sheet, which is disposed above the paper feeding unit 10. A paper arrangement unit 30, a feeding roller 41, and a printing unit 50 are disposed on a transfer path of the papers P transferred by the pick-up roller 11.

The paper arrangement unit 30 includes a driving roller 31 and a pinch roller 35 which are pressed in contact with each other to form a nip N'. The driving roller 31 is connected with a driving motor 39 supplying a rotation driving force. An electronic clutch 38 is disposed between the driving roller 31 and the driving motor 39 to intermittently connect or disconnect the driving roller 31 to or from the driving motor 35. A pinch spring 37 is placed at another side of the pinch roller 35. The pinch roller 35 rotates in conjunction with the driving roller 31 while being pressed thereto by the pinch spring 37. When a position sensor 33 disposed close to the paper arrangement unit 30 detects the paper P, the driving roller 31 does not rotate immediately, but instead waits for a predetermined period of time to prevent paper skewing when the front end Pt of the paper P moves diagonally. In the paper arrangement unit 30, when a leading portion of the paper P is transferred, the paper P is pushed back while being stuck between the two rollers 31 and 35. When the lagging portion of the paper P is moved, the driving roller 31 rotates so as to align the paper P.

The paper P is pushed by a feeding force while passing between the driving roller 31 and the pinch roller 35 and is transferred towards the feeding roller 41. After the paper P is transferred to the feeding roller 41, the paper P enters between the feeding roller 41 and a friction roller 43 and then between an ink cartridge 51 and a paper guide 59. The ink cartridge 51 discharges ink droplets on the transferring paper P to form a predetermined image. The printed paper P is then discharged out of the inkjet printer between a star wheel 61 and a discharge roller 63, which both rotate while being pressed against each other, and is then the printed paper is loaded on an out-feed tray 71.

Examples of papers which are commonly used for an image forming apparatus such as an ink-jet printer include a plain paper, an ink-jet paper, and a photo paper. Since these types of papers are made of a laminated sheet including a chemical coating layer, the ink-jet paper and the photo paper are thicker than plain paper. Conventionally, an arrangement operation is performed under the same conditions regardless of a type of a paper supplied to a paper arrangement unit. Accordingly, when a thin plain paper is used, the paper creases in the paper arrangement process due to a lack of rigidity. In addition, when a relatively thick ink-jet paper or a photo paper is used, although the arrangement operation is performed, the paper is supplied to a feeding roller in a skewed position, resulting in a paper jam. Also, even when no paper jam occurs, there still is a problem in that ink discharged from an ink cartridge escapes from the paper, causing poor printing.

SUMMARY OF THE INVENTION

The present general inventive concept provides an image forming apparatus that prevents overall problems occurring during a paper arrangement process by varying a pick-up speed according to a paper thickness, and a paper feeding method used with the image forming apparatus.

Additional aspects and advantages of the present general inventive concept will be set forth in part in the description which follows and, in part, will be obvious from the description, or may be learned by practice of the general inventive concept.

The foregoing and/or other aspects and utilities of the present general inventive concept may be achieved by providing an image forming apparatus including a paper feeding unit to accommodate a plurality of papers loaded thereon, a pick-up roller which picks up the papers loaded in the paper feeding unit and is set to rotate at multi-step speeds, a paper arrangement unit which aligns the papers to be transferred without skewing by applying a constant pressure to the front end of a paper transferred by the pick-up roller, a printing unit which is disposed below the paper arrangement unit and forms a predetermined image on the transferred paper, a paper type sensing element to identify the paper type and which is disposed on a paper transfer path along which the paper feeding unit, the pick-up roller, the paper arrangement unit, and the printing unit are arranged; and a control unit which operates the pick-up roller at a rotation speed according to an identified paper type.

The sensing element may comprise: a light source irradiating light on the paper; and an opto-electronic conversion element to receive light reflected from the paper.

The image forming apparatus may further comprise: a memory to store a rotation speed of the pick-up roller for each paper type, wherein the control unit checks the memory and reads a rotation speed corresponding to the paper from the memory.

The driving motor may be connected to an encoder generating a count signal in proportion to the number of revolutions of the motor.

The paper arrangement unit may include a driving roller which is rotated by a driving force, a pinch roller which co-rotates while being pressed to the driving roller, a shutter lever which is rotatably placed coaxially with the driving roller, is elastically supported in a predetermined rotation direction, and arranges the paper applying a constant pressure on the front end of the paper, and a tension elastic body which elastically biases the shutter lever in the predetermined rotation direction.

The image forming apparatus may further include a feeding roller and a friction roller which rotate in conjunction with each other and are disposed on a transfer path between the paper arrangement unit and the printing unit.

The sensing element may be supported by a two-folding link unit fixed at the upper side of the paper feeding unit and mounted on the paper on the paper feeding unit due to the weight of the sensing element.

The sensing element may be disposed in the transfer path between the paper arrangement unit and the feeding roller.

The printing unit may include a paper guide which supports a transferring paper and a print head which is separated by a predetermined distance from the paper guide. The sensing element may be disposed at the lower side of the paper guide, facing the paper.

The foregoing and/or other aspects and utilities of the present general inventive concept may also be achieved by providing a paper feeding method of an image forming apparatus, including reading a setting value set by a user for each paper type, driving a pick-up roller to pick up paper at a corresponding rotation speed for each paper type to a paper arrangement unit to arrange the paper, and driving the paper arrangement unit and supplying the arranged paper to a printing unit so as to align a front end of the picked-up paper.

When the user does not set the setting value, the method may further include operating a sensing element to identify each paper type and outputting the an identified paper signal to a control unit, and determining the paper type based on the identified paper signal input to the control unit, wherein the picking up operates the pick-up roller at a rotation speed corresponding to the identified paper type.

The foregoing and/or other aspects and utilities of the present general inventive concept may be achieved by providing an image forming apparatus, including a pick-up roller to pick up an image recording medium from an image recording medium tray and to forward the picked-up image recording medium at one of a plurality of speeds, a sensing unit to sense a type of image recording medium being picked-up by the pick-up roller and to generate a signal corresponding to the sensed type of image recording medium, a paper arrangement unit which applies a constant pressure to a front edge of the picked-up image recording medium and aligns the image recording medium to be transferred along a paper path, and a control unit to receive the generated signal and to control the pick-up roller speed based on the generated signal.

The sensing unit may be formed of first and second link members rotatably connected to each other at one end thereof, the first link member being connected to a body portion of the image forming apparatus at an opposite end thereof and the second link member including a sensing member therein which rotatably rests on the image recording medium within the image recording medium tray.

The paper arrangement unit may include a shutter lever disposed co-axially therewith and applies the constant pressure to the front edge of the image recording medium.

The paper arrangement unit may further include a driving roller to transfer the image recording medium received by the pick-up roller, and a pinch roller to press against the drive roller to form a nip in which the image recording medium is received, wherein the shutter lever is supported on a same rotation axis with the driving roller.

The shutter lever may include a tension elastic body placed on the rotation axis of the driving roller to elastically bias the shutter lever in a predetermined rotation.

The shutter lever may further include a stopper disposed along the shutter lever to engage with the tension elastic body to limit a rotation angle of the shutter lever.

The sensing unit may include a first sensing part to detect data input by a user representing a printing instruction including a recording medium type and generates a first signal corresponding to the data input by the user, and a second sensing part to detect the type of recording medium placed on the recording medium tray and generates a second signal corresponding to the detected type of recording medium, wherein if the first sensing part detects data input by the user, the control unit controls the pick-up roller speed based on the first generated signal and if the first sensing part does not detect data input by the user, the control unit controls the pick-up roller speed based on the second generated signal.

The foregoing and/or other aspects and utilities of the present general inventive concept may be achieved by providing an image forming apparatus, including a feeding unit to feed an image recording medium from an image recording medium tray at one of a plurality of speeds, a sensing unit to sense a type of image recording medium to be fed by the feeding unit and to generate a signal corresponding to the sensed type of image recording medium, a paper arrangement unit which receives the fed image recording medium from the feeding unit and transfers the image recording medium along a paper transfer path while applying a predetermined bias to a front edge of the image recording medium in an opposite direction to the feeding direction in order to align the image recording medium along the paper transfer path; and a control unit to receive the generated signal and to control the feeding unit at one of the plurality of speeds based on the generated signal.

The paper arrangement unit may include a pair of rollers forming a nip therebetween in which the image recording medium is fed, and an elastically biased member that is connected to an axis of rotation of one of the pair of rollers to rotate along an axis of rotation of the one of the pair of rollers by a predetermined degree of rotation to align the image recording medium as the image recording medium passes through the nip.

BRIEF DESCRIPTION OF THE DRAWINGS

These and/or other aspects and advantages of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
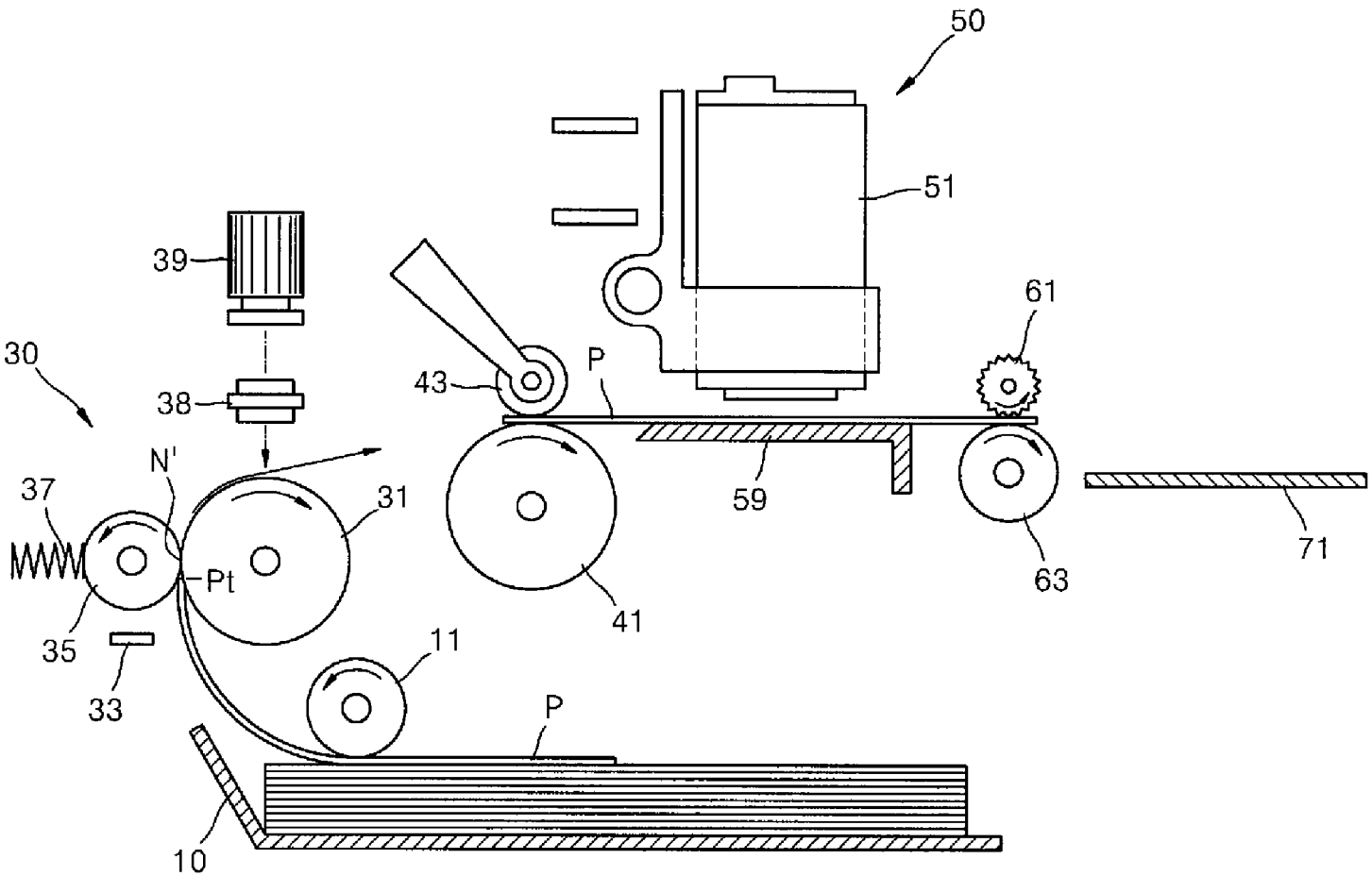
FIG. 1 (PRIOR ART)
FIG. 1 is a schematic view of a structure of a conventional image forming apparatus.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

Figure 2:
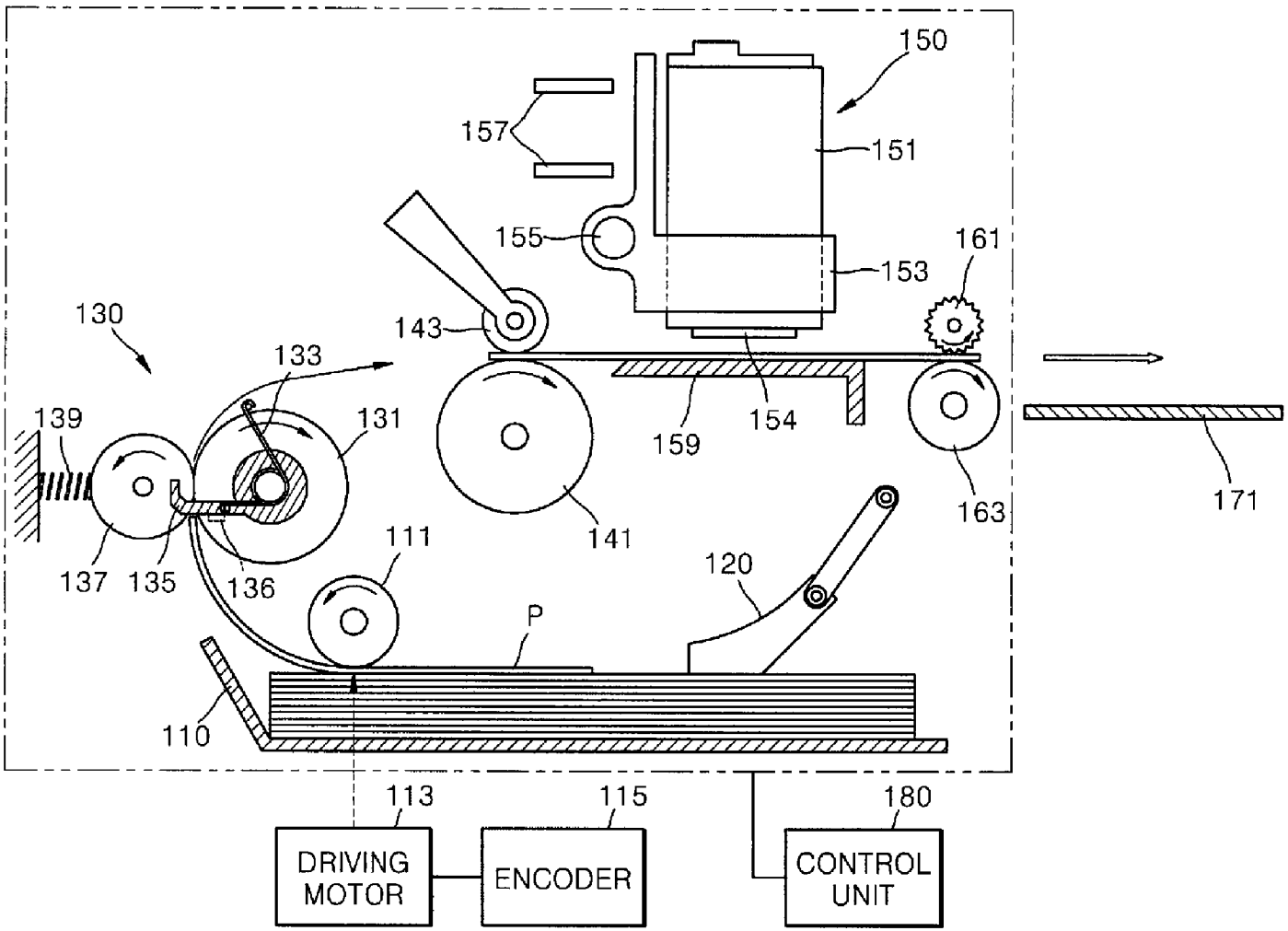
FIG. 2 is a schematic view of a structure of an image forming apparatus according to an embodiment of the present general inventive concept.

Referring to FIG. 2, an image forming apparatus according to an embodiment of the present general inventive concept includes a pick-up roller 111, a paper arrangement unit 130, and a feeding roller 141 which are disposed along an approximately C-shaped transfer path to supply a paper P (or other image recording medium) into a printing unit 150 inside the apparatus.

Figure 3:
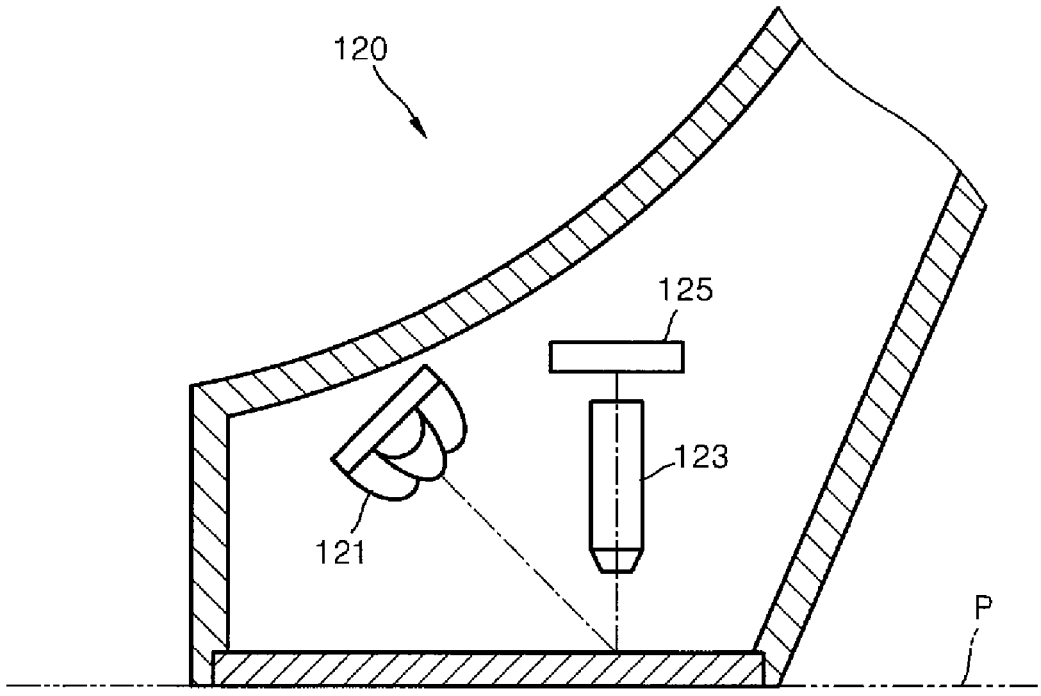
FIG. 3 is a schematic view of a structure of a sensing element of FIG. 2.

A paper feeding unit 110 stores a plurality of papers P waiting to be transferred. A sensing element 120 can be disposed on the loaded papers P. FIG. 3 illustrates a schematic view of an inner structure of the sensing element 120. Referring to FIG. 3, the sensing element 120 can include a light source 121 that irradiates light onto a paper P and an opto-electronic conversion element 125 which condenses light reflected from the paper P and outputs the light as an electrical signal. A glass rod 123 to provide a light path may be provided between the light source 121 and the opto-electronic conversion element 125. Examples of papers (or other recording media) commonly used for an ink-jet printer include a plain paper, an ink-jet paper, and a photo paper. Such papers have different light reflection rates based on usage, and a type of the paper P stored in the paper feeding unit 110 can be easily detected by measuring an intensity of reflected light. For example, a table having light intensity data with respect to each paper is stored in a system to provide preliminary information, and the light intensity data obtained by the sensing element 120 is sent to a control unit 180. The control unit 180 detects the type of the paper using the received light intensity data and the preliminary stored data. The detection of the type of the paper P is performed to appropriately perform printing according to the thickness of the paper to prevent paper wrinkling or paper misalignment. Meanwhile, as illustrated in FIG. 2, the sensing element 120 can be supported by a two-folding link unit fixed at an upper side of (or above) the paper feeding unit 110. The sensing element 120 may be mounted on or rest on top of the paper P loaded on the paper feeding unit 110 due to the weight of the sensing element 120. The pick-up roller 111 is disposed above the paper feeding unit 110, and the papers P stored in the paper feeding unit 110 are transferred sheet by sheet by the pick-up roller 111. The pick-up roller 111 is connected to a driving motor 113 that supplies a rotation driving force, and the sheet of paper P to be printed is discharged from the paper feeding unit 110 when the pick-up roller 111 rotates while being pressed into contact with the sheet of paper P. The pick-up driving motor 113 is controlled by the control unit 180, which speeds up and slows down a rotation speed of the driving motor 113 based on the type of the paper P stored in the paper feeding unit 110. When the control unit 180 detects that the paper P to be picked up is relatively thin, for example, the paper P is plain paper, the driving motor 113 is controlled to rotate fast. When the control unit 180 detects that the paper P to be picked up is relatively thick, for example, photo paper, the driving motor 113 is controlled to rotate slowly. An encoder 115 may be connected to the driving motor 113. The number of pulses generated by the encoder 115 in response to operations of the driving motor 113 can be counted to detect and feed back the number of revolutions of the driving motor 113, so that the number of revolutions of the driving motor 113 can be uniformly controlled.

Figure 4A:
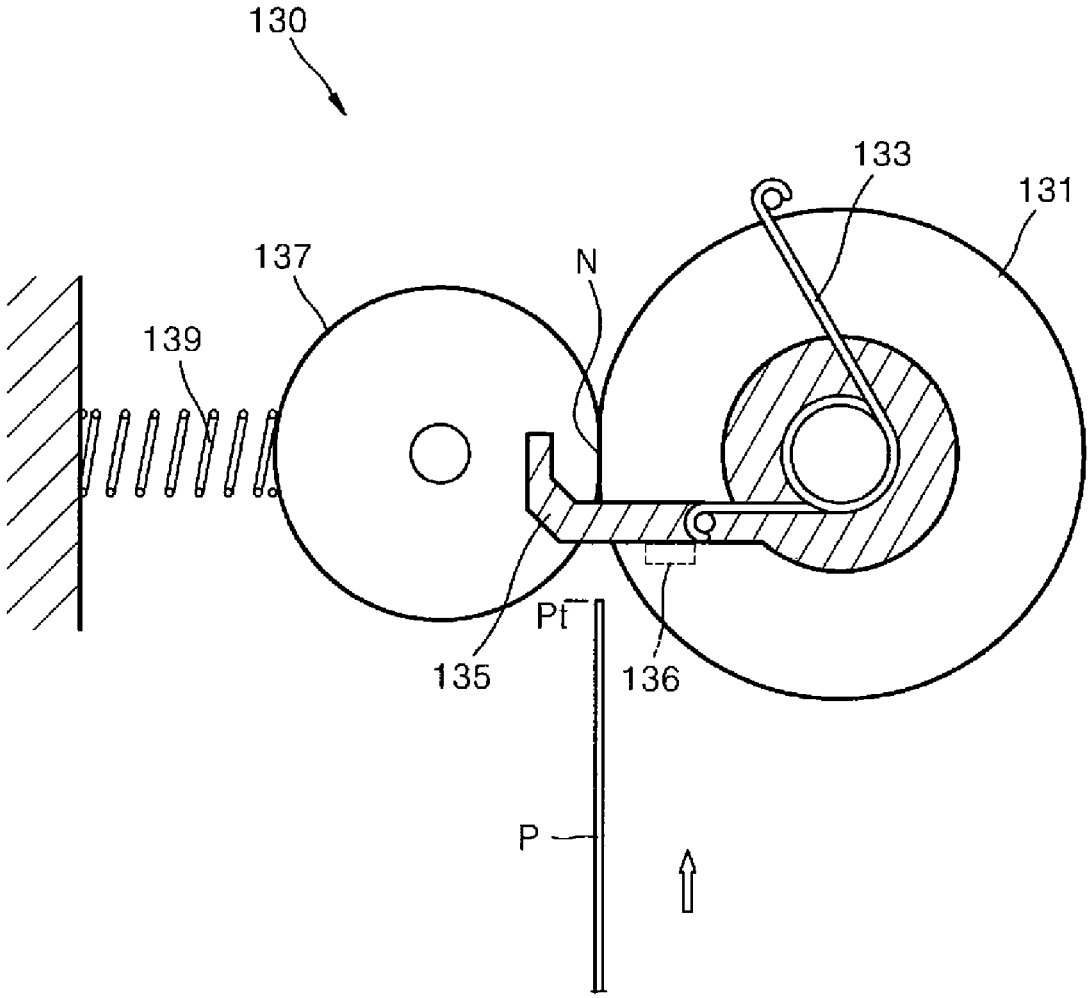
FIGS. 4A and 4B are views of a paper arrangement unit of FIG. 2.
Figure 4B:
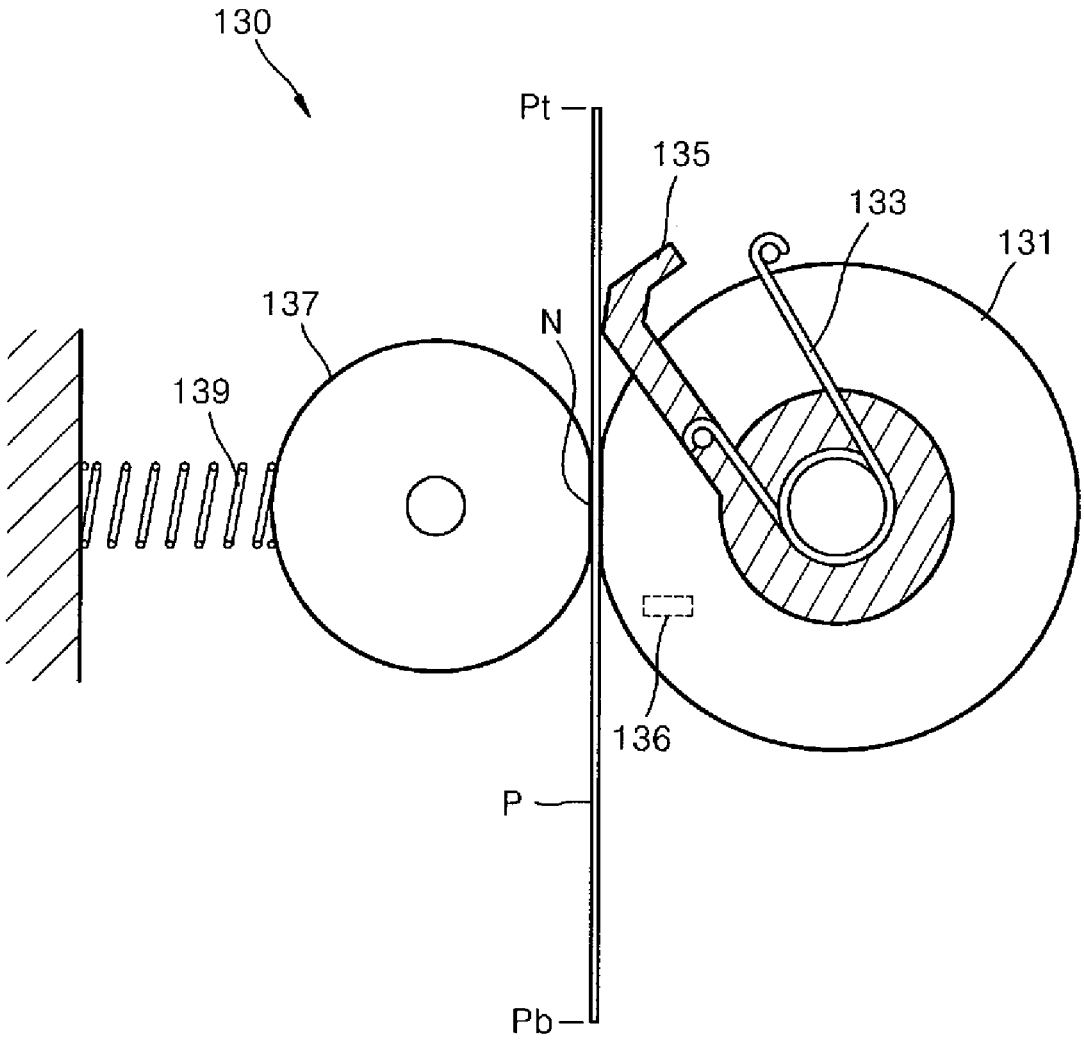

The paper P picked up by the pick-up roller 111 is supplied to the paper arrangement unit 130. Operations of the paper arrangement unit 130 are illustrated in FIGS. 4A and 4B. Referring to the drawings, the paper arrangement unit 130 includes a pair of rollers including a driving roller 131 and a pinch roller 137 pressed against each other, and a shutter lever 135 rotatably supported on the same rotation axis of the driving roller 131. The driving roller 131 is connected to a driving motor (not illustrated), and the pinch roller 137 rotates along with the driving roller 131 while being pressed by a spring 139. The shutter lever 135 is elastically biased in a predetermined rotation direction (counterclockwise in the drawing) by a tension elastic body 133 placed on the axis of the shutter lever 135. A rotation angle of the shutter lever 135 is limited by a stopper 136 disposed in front of a nip N between the rollers 131 and 137 in a paper transfer direction. The paper P supplied to the paper arrangement unit 130 comes in contact with the shutter lever 135 prior to entering the nip N. Since a front end Pt of the paper P is transferred while pushing the shutter lever 135, which is biased in the opposite direction from the direction of the paper P, the shutter lever 135 is pushed clockwise, and the paper P enters the nip N between the driving roller 131 and the pinch roller 137. When a rear end Pb of the paper P exits the nip N, the shutter lever 135 returns to an original position by an elastic force from the tension elastic body 133.

The paper arrangement unit 130 arranges the front end Pt of the paper P so that the paper P is transferred to the printing unit 150 without skewing. Although not illustrated, the front end Pt of the paper P, which is first transferred to the paper arrangement unit 130, is interrupted by the shutter lever 135, forms a loop shape due to an elastic force of the shutter lever 135, and pushes the shutter lever 135 when the front end Pt of the paper P arrives at the shutter lever 135. In the present general inventive concept, different paper arrangement conditions are provided by changing the pick-up speeds according to the thickness of the paper P. Namely, when a thin paper having a small rigidity is used, the paper arrangement is rapidly performed by increasing the paper pick-up speed. In addition, when a thick paper having a large rigidity is used, the paper arrangement is sufficiently performed by reducing the paper pick-up speed. In the case of using the thin paper, since a paper curvature caused by the shutter lever 135 increases, the front end Pt of the paper P is highly likely to wrinkle. In addition, since a constant elastic force is acting on the shutter lever 135 regardless of characteristics of supplied papers, it is hard to expect a sufficient arrangement effect when the thick paper is used. To solve these problems, in the present general inventive concept, preliminary data on the thickness of the paper is acquired by the sensing element 120, and the paper pick-up speed is controlled according to the characteristic of each paper, so that various problems occurring during a paper arrangement process can be prevented.

The front end Pt of the paper P, which pushes the shutter lever 135, enters the nip N between the driving roller 131 and the pinch roller 137. When the rear end Pb of the paper P leaves the shutter lever 135, the shutter lever 135 returns to an original position by rotating counter-clockwise by an elastic force of the tension elastic body 133.

Referring back to FIG. 2, the paper P, which is pushed by a feeding force while passing through the nip N between the driving roller 131 and the pinch roller 137, is transferred to the feeding roller 141. The paper P, which has passed through the feeding roller 141 and a friction roller 143, which is in contact with the feeding roller 141, is positioned on a paper guide 159, and waits for an ink cartridge 151 to perform a printing operation. The ink cartridge 151 is placed in a carrier 153 and reciprocates in a perpendicular direction with respect to a transfer direction of the paper P. The carrier 153 reciprocates by a carrier belt 157, and a guide shaft 155 guides the reciprocating movement of the carrier 153. A print head 154 having a plurality of nozzles thereon is placed at the lower end of the ink cartridge 151. The print head 154 discharges ink droplets on the paper P through the nozzles. A predetermined image is formed on the paper P by the discharged ink, the printed paper P is discharged out of the image forming apparatus between a star wheel 161 and a discharge roller 163 rotating in contact with each other, and the discharged paper P is loaded in an out-feed tray 171. The outer circumference of the star wheel 161 has a plurality of teeth having a saw tooth shape, and therefore minimizes a contact surface between the star wheel 161 and the paper P, to prevent the paper P from being stained by ink.

Figure 5:
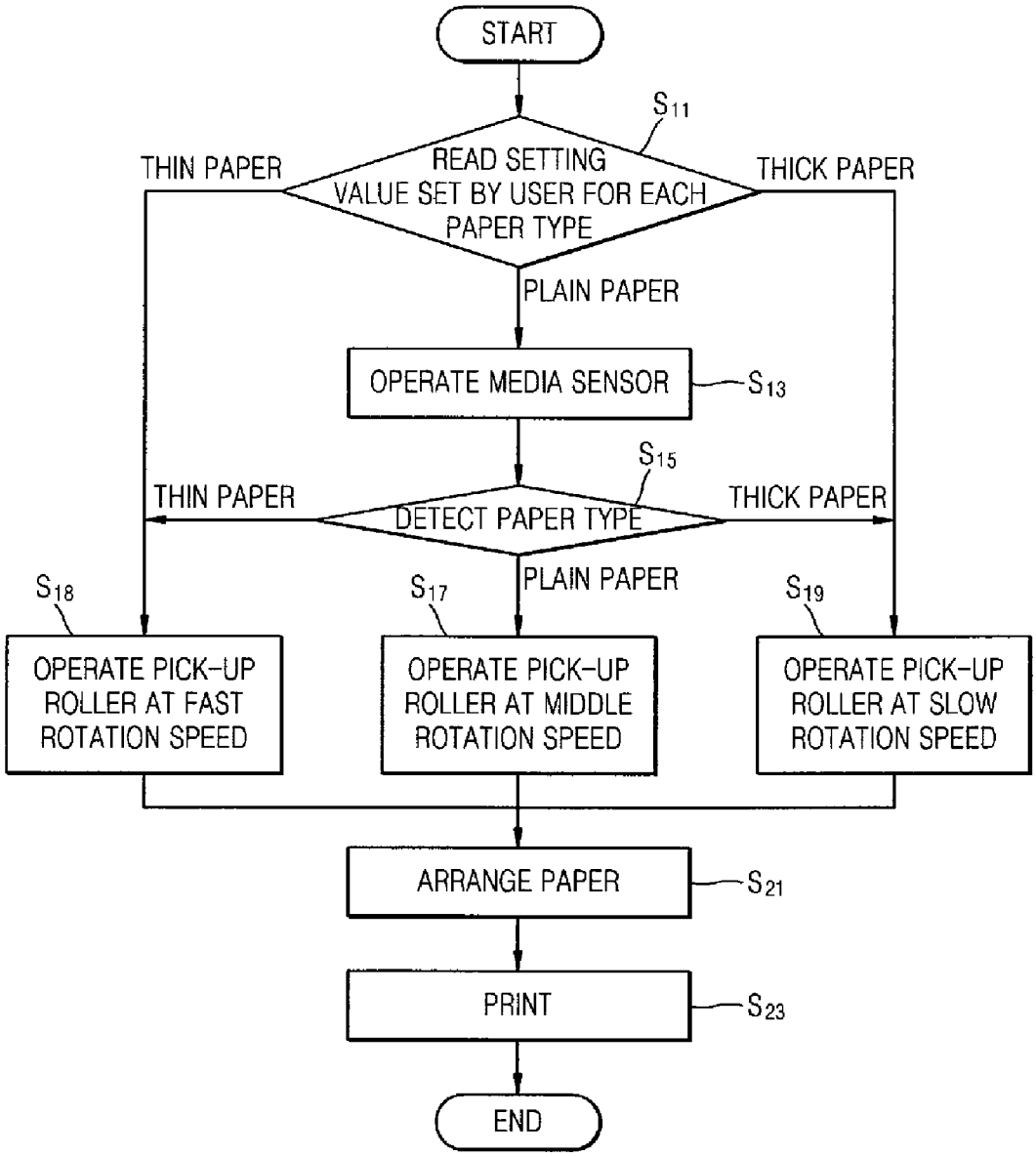
FIG. 5 is a flowchart of a paper feeding method of an image forming apparatus according to an embodiment of the present general inventive concept.

Hereinafter, a paper feeding method of the control unit 180 will be described in detail with reference to FIG. 5. When a user sends a printing instruction, the control unit 180 reads initial setting values input by the user in order to set a printing condition (operation S11). Examples of the setting values input by the user include a paper size, the number of papers to be printed, and a print density. In particular, in the present general inventive concept, data on a paper type is included in the setting values. For example, the user may select to turn on any one of a plain paper, an ink-jet paper, a photo paper shown in an initial setting menu. In FIG. 5, the paper type is simply indicated as thin paper, plain paper, or thick paper for clarity.

Next, the control unit 180 operates the pick-up driving motor 113 in order to discharge the paper P loaded on the paper feeding unit 110 (operations S18 and S19). After the user selects the paper type, the driving motor 113 operates at a constant speed according to the selected paper type. For example, if the user selects the thin paper, the driving motor 113 rotates fast (operation S18) to prevent the paper from wrinkling during a paper arrangement process described below. In contrast, if the user selects the thick paper, the driving motor 113 rotates slowly (operation S19) to perform a paper arrangement sufficiently based on the thicker paper.

When the picked up paper P enters into a paper arrangement unit 130, the paper arrangement process described with reference to FIGS. 4A and B is performed (operation S21). Although not illustrated, in order to detect a starting time when the paper P enters into the paper arrangement unit 130, a position sensor (not illustrated) may be placed on a transfer path of the paper P, and the control unit 180 may operate a driving force motor of the paper arrangement unit 130 in response to a sensing signal of the position sensor. The paper P which has passed through the paper arrangement unit 130 enters into the printing unit 150 via the feeding roller 141, and the control unit 180 detects the paper P and then operates the printing unit 150. In order to control a staring time of the printing unit 150, the position sensor may be disposed in front of the printing unit 150. Also, the starting time may be set to a predetermined time after the paper enters into the paper arrangement unit 130. The operation of the printing unit 150 is the same as in the description with reference to FIG. 2, so detailed descriptions thereof will be omitted.

On the other hand, if there is no input by the user with regard to the paper type, the paper type is set to a default setting value, for example, a plain paper having a common thickness. When the paper type is set to the default setting value, the control unit 180 operates the sensing element 120 prior to operating the pick-up driving motor 113 (operation S13). As described with reference to FIG. 3, the sensing element 120 detects the intensity of reflected light after irradiating light on the paper P loaded on the paper feeding unit 110. The control unit 180 determines the type of the paper P loaded on the paper feeding unit 110 according to a detection signal in response to the intensity of the reflected light (operation S15), and then operates the pick-up driving motor 113 to discharge the paper P from the paper feeding unit 110 (operations S17, S18, and S19). Here, the control unit 180 operates the pick-up driving motor 113 at a predetermined constant rotation speed according to the determined paper type. For example, when a thin paper is used, the driving motor 113 operates at a fast rotation speed (operation S18), and when a thick paper is used, the driving motor 113 operates at a relatively slow rotation speed (operation S19). In addition, when a paper having a middle thickness is used, the driving motor 113 operates at a rotation speed corresponding thereto (operation S17). The pick-up roller 111 connected with the driving motor 113 picks up the paper P loaded on the paper feeding unit 110 sheet by sheet to be supplied to the paper arrangement unit 130 (operation S21). The arranged paper is discharged out of the apparatus via the printing unit 150 (operation S23).

Meanwhile, in alternative embodiments of the present general inventive concept, the sensing element 120 that identifies the paper type may be disposed on various transfer paths from the paper feeding unit 110 to the printing unit 150. In addition, the present embodiment is not limited thereto. As illustrated in FIG. 2, the sensing element 120 may be disposed at the upper side of the paper feeding unit 110. In contrast, the sensing element 120 may be disposed on a transfer path between the paper arrangement unit 130 and the feeding roller 141 or inside the printing unit 150. For example, when the sensing element 120 is disposed inside the printing unit 150, the sensing element 120 may be disposed at the lower side of the paper guide, facing the paper.

Accordingly, in an image forming apparatus and a paper feeding method thereof according to the present general inventive concept, overall problems occurring during a paper arrangement process can be prevented by using different paper pick-up speeds based on a paper thickness. For example, when a thin paper having a small rigidity is used, an arrangement operation is performed fast to prevent wrinkling of the paper in an arrangement process. Meanwhile, when a thick paper is used, a paper pick-up speed is reduced to perform the arrangement process sufficiently, in order to prevent poor printing caused by paper skewing.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. An image forming apparatus comprising:

a paper feeding unit to accommodate a plurality of recording media loaded thereon;

a pick-up roller which picks up the recording media loaded in the paper feeding unit and is set to rotate at multiple rotation speeds;

a paper arrangement unit which aligns the recording media to be transferred without skewing by applying a constant pressure to a front end of the recording media transferred by the pick-up roller;

a printing unit disposed below the paper arrangement unit to form a predetermined image on the transferred recording media;

a paper type sensing element disposed on a paper transfer path along which the paper feeding unit, the pick-up roller, the paper arrangement unit, and the printing unit are arranged to sense a type of the recording media picked up; and a control unit which operates the pick-up roller at a rotation speed according to the type of the recording media sensed by the paper type sensing element.

2. The image forming apparatus of claim 1, wherein the paper type sensing element comprises:

a light source to irradiate light on the recording media; and an opto-electronic conversion element to receive light reflected from the recording media.

3. The image forming apparatus of claim 1, further comprising:

a memory to store a rotation speed of the pick-up roller for each recording media type, wherein the control unit checks the memory and reads a rotation speed corresponding to the identified recording media from the memory.

4. The image forming apparatus of claim 1, wherein the pick-up roller is connected to a driving motor that is connected to an encoder that generates a count signal in proportion to the number of revolutions of the driving motor.

5. The image forming apparatus of claim 1, wherein the paper arrangement unit comprises:

a driving roller which rotates by a driving force;

a pinch roller which co-rotates while being pressed to the driving roller;

a shutter lever which is rotatably placed coaxially with the driving roller, is elastically supported in a predetermined rotation direction, and arranges the recording media by applying a constant pressure on a front end of the recording media; and a tension elastic body which elastically biases the shutter lever in the predetermined rotation direction.

6. The image forming apparatus of claim 1, further comprising a feeding roller and a friction roller which rotate in conjunction with each other and are disposed on a transfer path between the paper arrangement unit and the printing unit.

7. The image forming apparatus of claim 6, wherein the paper type sensing element is disposed in the paper transfer path between the paper arrangement unit and the feeding roller.

8. The image forming apparatus of claim 1, wherein the paper type sensing element is supported by a two-folding link unit fixed above the paper feeding unit, and contacts the recording media in the paper feeding unit due to a weight of the paper type sensing element.

9. The image forming apparatus of claim 1, wherein:

the printing unit comprises:

a paper guide which supports recording media being transferred, and a print head which is separated by a predetermined distance from the paper guide; and the paper type sensing element is disposed at a lower side of the paper guide, facing the paper.

10. An image forming apparatus, comprising:

a pick-up roller to pick up an image recording medium from an image recording medium tray and to forward the picked-up image recording medium at one of a plurality of speeds;

a sensing unit to sense a type of image recording medium being picked-up by the pick-up roller and to generate a signal corresponding to the sensed type of image recording medium;

a paper arrangement unit which applies a constant pressure to a front edge of the picked-up image recording medium and aligns the image recording medium to be transferred along a paper path; and a control unit to receive the generated signal from the sensing unit and to control the pick-up roller speed based on the generated signal.

11. The image forming apparatus of claim 10, wherein the sensing unit is formed of first and second link members rotatably connected to each other at one end thereof, the first link member being connected to a body portion of the image forming apparatus at an opposite end thereof and the second link member including a sensing member therein which rotatably rests on the image recording medium within the image recording medium tray.

12. The image forming apparatus of claim 10, wherein the paper arrangement unit comprises a shutter lever disposed co-axially therewith and applies the constant pressure to the front edge of the image recording medium.

13. The image forming apparatus of claim 12, wherein the paper arrangement unit further comprises:

a driving roller to transfer the image recording medium received by the pick-up roller; and a pinch roller to press against the drive roller to form a nip in which the image recording medium is received, wherein the shutter lever is supported on a same rotation axis with the driving roller.

14. The image forming apparatus of claim 13, wherein the shutter lever comprises a tension elastic body placed on the rotation axis of the driving roller to elastically bias the shutter lever in a predetermined rotation.

15. The image forming apparatus of claim 14, wherein the shutter lever further comprises:

a stopper disposed along the shutter lever to engage with the tension elastic body to limit a rotation angle of the shutter lever.

16. The image forming apparatus of claim 10, wherein the sensing unit comprises:

a first sensing part to detect data input by a user representing a printing instruction including a recording medium type and generates a first signal corresponding to the data input by the user; and a second sensing part to detect the type of recording medium placed on the recording medium tray and generates a second signal corresponding to the detected type of recording medium, wherein if the first sensing part detects data input by the user, the control unit controls the pick-up roller speed based on the first generated signal and if the first sensing part does not detect data input by the user, the control unit controls the pick-up roller speed based on the second generated signal.

17. The image forming apparatus of claim 16, wherein the printing instruction input by the user includes a recording medium size, a number of recording media, and a density of the recording media.

18. An image forming apparatus, comprising:

a feeding unit to feed an image recording medium from an image recording medium tray at one of a plurality of speeds;

a sensing unit to sense a type of image recording medium to be fed by the feeding unit and to generate a signal corresponding to the sensed type of image recording medium;

a paper arrangement unit which receives the fed image recording medium from the feeding unit and transfers the image recording medium along a paper transfer path while applying a predetermined bias to a front edge of the image recording medium in an opposite direction to the feeding direction in order to align the image recording medium along the paper transfer path; and a control unit to receive the generated signal from the sensing unit and to control the feeding unit at one of the plurality of speeds based on the generated signal.

19. The image forming apparatus of claim 18, wherein the paper arrangement unit comprises:

a pair of rollers forming a nip therebetween in which the image recording medium is fed; and an elastically biased member that is connected to an axis of rotation of one of the pair of rollers to rotate along an axis of rotation of the one of the pair of rollers by a predetermined degree of rotation to align the image recording medium as the image recording medium passes through the nip.

* * * * *